United States Patent [19]

Ohashi

[11] Patent Number: 5,038,004

[45] Date of Patent: Aug. 6, 1991

[54] MINIATURE SWITCH

[75] Inventor: Shigeo Ohashi, Tokyo, Japan

[73] Assignee: Nihon Kaiheiki Kogyo Kabushiki Kaisha, Tokyo, Japan

[21] Appl. No.: 527,360

[22] Filed: May 23, 1990

[30] Foreign Application Priority Data

Jun. 26, 1989 [JP] Japan ..... 1-163280

[51] Int. Cl.[5] ..... H01H 15/00

[52] U.S. Cl. ..... 200/16 C; 200/16 D

[58] Field of Search ..... 200/1 R, 1 V, 2, 16 R, 200/16 C, 16 D

[56] References Cited

U.S. PATENT DOCUMENTS 1,005,521 10/1911 Doughty et al. ..... 200/2

2,303,693 12/1942 Hill ..... 200/16 C X 3,735,059 5/1973 Glaser et al. ..... 200/16 C 4,029,917 6/1977 Webster ..... 200/16 D X

*Primary Examiner*—J. R. Scott

[57] ABSTRACT

A miniature switch comprises a switch body and at least one switching member mounted on the switch body. The switch body is provided at longitudinally central portion thereof with a groove. Pairs of fixed contacts are disposed in juxtaposition on the bottom of the groove along thereof. The switching member has one or two contacts disposed therein in desired positions or directions. The switching member is mounted in the switch body so that the contact(s) of the switching member bridge over the desired contacts of the switch body.

11 Claims, 3 Drawing Sheets

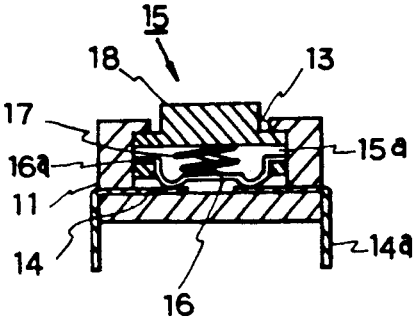
FIG. 1
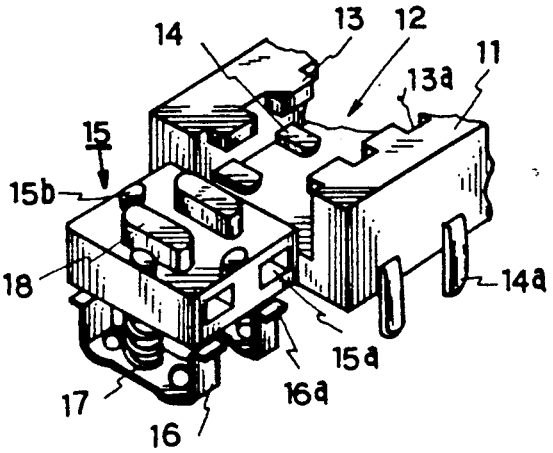
FIG. 2
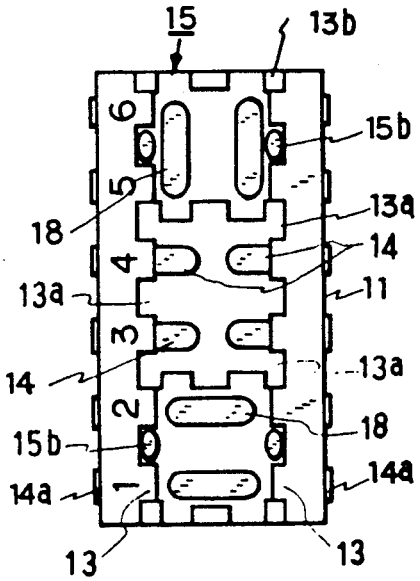
FIG. 3
FIG. 4A
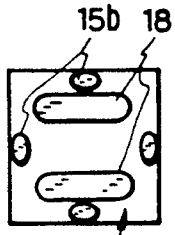
FIG. 4B
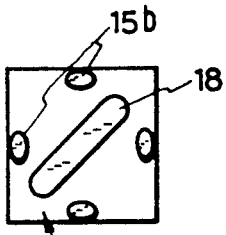
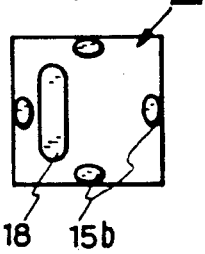
FIG. 4C
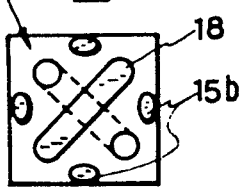
FIG. 4D

MINIATURE SWITCH

BACKGROUND OF THE INVENTION

1. Field of the Invention

This invention relates to a miniature switch, and more particularly a miniature switch in which a number of desired circuits can be set by disposing a plurality of switching members in any direction.

2. Description of Related Art

In conventional miniature switches, as shown in FIG. 10, a plurality of sliding members 112 were disposed in juxtaposition or in two rows on a switch body 111 and the switching of the contacts was made by sliding one or more sliding members in one particular direction.

The aforementioned conventional miniature switches are limited to an on-off switching between opposite or facing contacts, and it is therefore difficult to provide switching circuits between juxtaposed circuits or contacts, and between diagonally disposed circuits or contacts. Thus, in order to provide such switching circuits, it requires any other means such as a pattern formed on an outside wiring or a printed circuit board.

SUMMARY OF THE INVENTION

The present invention is made in view of the above-mentioned conventional disadvantages, and it is therefore an object of the invention to provide a novel miniature switch which is capable of overcoming the disadvantages of the conventional switches.

In order to accomplish this and other objects, the miniature switch in accordance with the invention is constructed so that a switch body is provided at a central portion thereof with a groove, a plurality of fixed contacts are disposed in two rows on the bottom of the groove, switching members engaged with or provided with contacts are capable of being disposed in the groove in any direction, and the contacts of the switching members bridge over desired fixed contacts of the switching body.

In accordance with the features of the invention, each of the switching members is capable of being disposed in any direction, that is, each switching member engaged with or provided with contacts is disposed in the switch body provided with fixed contacts so that the contacts of the switching member bridge over the desired fixed contacts of the switch body, and each switching member once disposed is displaceable in a different direction or replaceable with a different form of switching member.

BRIEF DESCRIPTION OF THE DRAWINGS

Other objects and aspects of the invention will become apparent from the following description of the embodiments with reference to the accompanying drawings in which:

FIG. 1 is a side cross-section view showing a first embodiment according to the invention;

FIG. 2 is an exploded perspective view showing the first embodiment;

FIG. 3 is a plan view showing the first embodiment;

FIGS. 4A through 4D are plan views showing variations of switching members according to the invention, showing locations of its various contacts;

DESCRIPTION OF THE PREFERRED EMBODIMENTS

Figure 5:
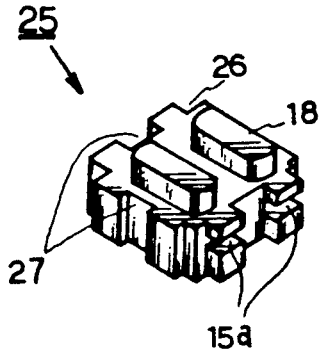
FIG. 5 is a perspective view showing still another embodiment of the switching member provided with recesses on its upper surface.

FIGS. 1 through 3 show a first embodiment according to the invention, FIG. 1 being a side cross-section view, FIG. 2 an exploded perspective view, and FIG. 3 a plan view.

Referring now to FIGS. 1 through 3, a rectangular switch body 11 is formed with a groove 12 which has projecting plates 13 on the upper portion of the switch body 11. A plurality of opposite or facing recesses **13*a* are provided on the projecting plates, which are provided along both sides of the upper portion of grooves 12. Fixed contacts 14 are disposed opposite to each other on the bottom of the switch body 11 and one end of each fixed contact projects downward to form a terminal 14*a*. A switching or diverting member 15 is provided at both sides thereof with lateral through-apertures 15*a* which are open to the bottom of the switching member. A contact 16 which is bent in a C-shaped form and provided at ends thereof with jaws 16*a* is received in the through-apertures 15*a*, and is biased toward the central bottom portion of the groove 12 through an action of a spring 17. If the contact 16 is constructed so that the contact itself has its own resiliency or spring force, the spring 17 may be omitted. The switching member 15 is provided at four points on the upper surface thereof with projections 15*b*. Thus, the switching member 15 is disposed within the groove 12 of the switch body 11 in a projection-recess relationship with the recesses 13*a* on the upper portion of the switch body 11, so that the contacts 16 of the switching member bridge over the opposite fixed contacts 14** of the switch body.

The switching member 15 is also provided at the upper surface thereof with raised portions 18 indicating positions in which the contacts 16 are located.

In use, the switching member 15 is inserted endwise into the groove 12 of the switch body 11 and slid along the groove 12 while the switching member 15 is pushed downward from above by a finger, so that the projections **15*b* are caused to be snappingly engaged with the recesses 13*a* formed on the projecting plates 13. As a consequence, the switching member 15 is fixed to the switch body 11 along the groove 12 thereof and the contacts 16 are engaged with corresponding fixed contacts 14, that is, the contacts 16 are caused to bridge over the desired fixed contacts 14 to form a desired circuit. Furthermore, when the switching member 15 is moved along the groove 12 while the switching member is pushed downward, the projections 15*b* of the switching member slides under the lower surfaces of the projecting plates 13 and then is snappingly engaged with the next recesses 13***a* to be fixed therein as the projections 15*b* reach the recesses 13*a*. Thus, connections between the contacts 16 and the fixed contacts 14 are switched over or the circuit is changed, that is, a switching action is made or the circuit is changed into a new one. When the switching member which has contacts 16 formed therein in juxtaposition is altered by a right angle in a direction of its insertion, the circuit pattern thus formed is varied.

FIGS. 4A through 4D show the upper surface of the switching member and indicate various arrangements of contacts.

Referring to FIGS. 4A through 4D, FIG. 4A shows an example of the switching member for use in the first embodiment as shown in FIGS. 1 through 3, in which two contacts 16 are disposed in parallel. FIG. 4B shows an example of a switching member which is provided with a diagonal contact 16, and FIG. 4C shows an example of a switching member which is provided with only a single lateral contact 16. FIG. 4D shows an example of a switching member which is provided with diagonally crossed contacts 16. By the use of these switching members, it is possible to make various circuits.

FIG. 5 is a perspective view showing another embodiment of a switching member.

Referring to FIG. 5, a switching member 25 is formed at corners thereof with cut-outs 26 and at the central portion thereof with recesses 27. Thus, the switching member 25 is of such a construction that it can be mounted in the switch body. That is, the switching member is mounted in the switch body by inserting convex portions formed between the cut-outs 26 and the recesses 27 into the recesses 13*a* formed on the switch body, and then displacing the switching member in a direction along the groove 12 to cause these convex portions to be engaged with the projecting portions formed between the recesses 13*a*.

Figure 6:
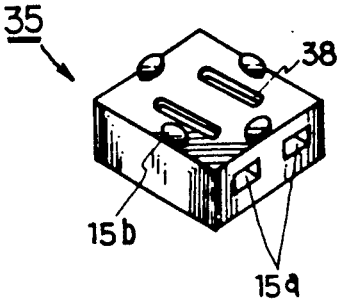
FIG. 6 is a perspective view showing another embodiment of the switching member formed with recesses at the upper surface thereof.

FIG. 6 shows another embodiment in which a switching member 35 is formed at the upper surface thereof with recesses 38, instead of raised portions 18 as shown in FIG. 2, to indicate locations of the contacts. This switching member can be slid by inserting a screw driver into one of recesses 38, and the other construction is similar to that of FIG. 4A.

Figure 7:
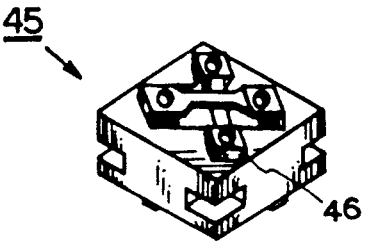
FIG. 7 is a perspective view showing a further embodiment of the switching member having contacts disposed differently.

FIG. 7 is a bottom perspective view showing still another embodiment in which diagonally crossed contacts 46 are provided on a switching member 45, and which has the same functions as those of FIG. 4D.

Figure 8A:
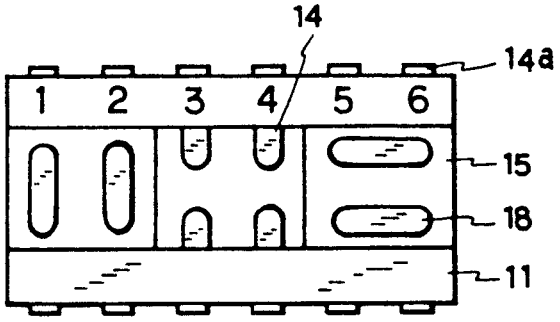
FIG. 8A is a perspective view showing a second embodimemnt according to the invention.
Figure 8B:
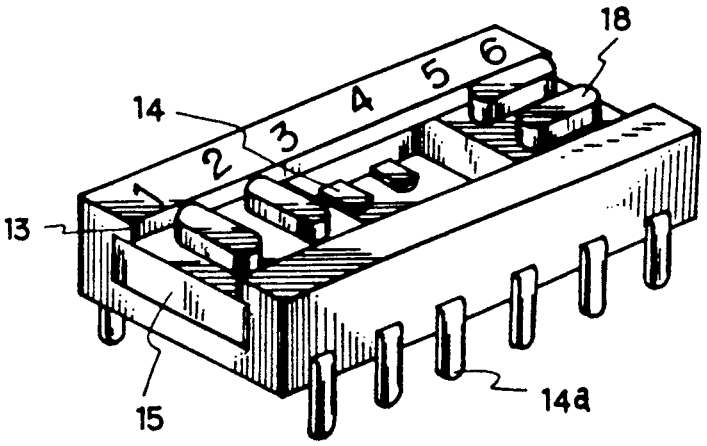
FIG. 8B is a perspective view showing the second embodiment.

FIGS. 8A and 8B are a plan view and a perspective view, respectively, showing a second embodiment according to the invention in which switching members are constructed so that they are slidable without positioning them on the basis of a convex-concave relationship.

Referring to FIGS. 8A and 8B, the projecting plates 13 provided on the switch body are not formed with recesses 13*a* as shown in the first embodiment and the projections 15*b* are removed from the upper surface of the switching member 15.

Figure 9:
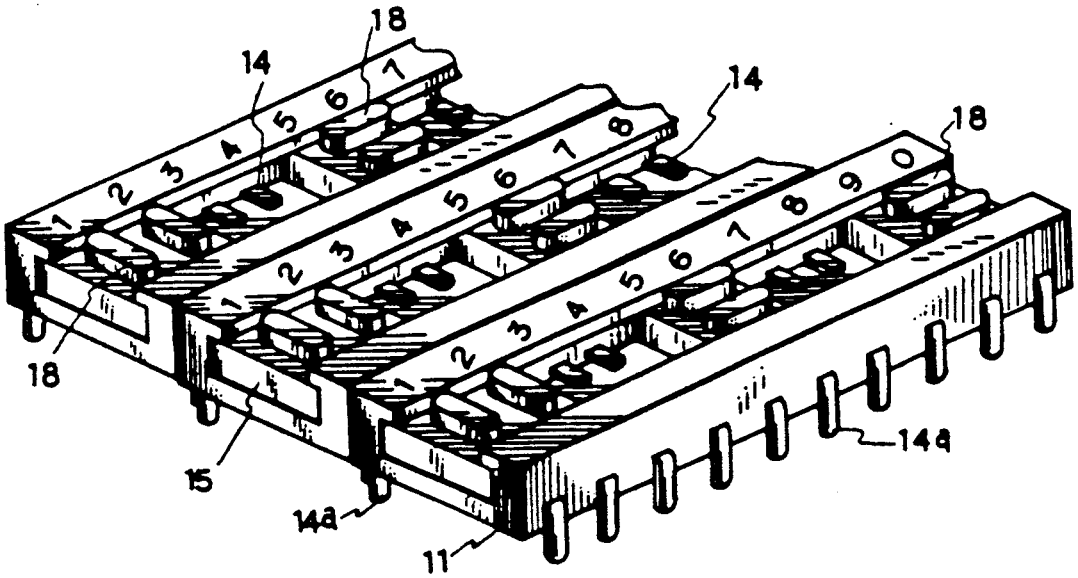
FIG. 9 is a perspective view showing an application of the switch in accordance with the invention to a data module.
Figure 10:
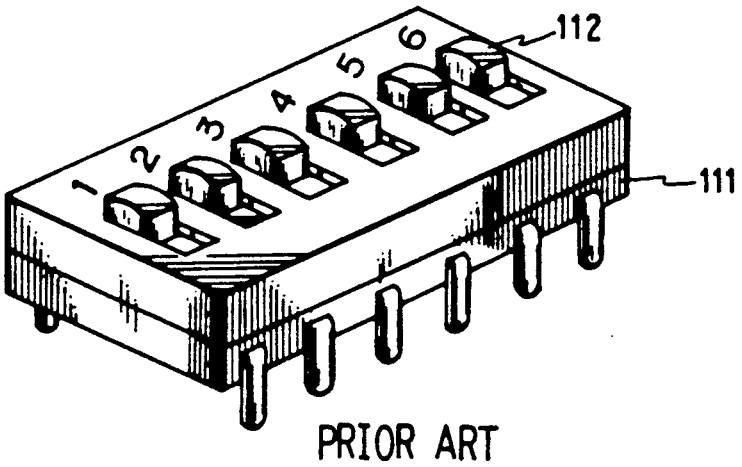
FIG. 10 is a perspective view showing a prior art miniature switch.

FIG. 9 is a perspective view showing an example of a case where minature switch is used for a data module.

In accordance with the above-mentioned various constructions of the miniature switch of the invention, the following advantages will be attained:

(1) Since, in accordance with the invention, a miniature switch is construced so that a groove is provided in a switch body at substantially central portion thereof, a switching member engaged with contact(s) is disposed on a plurality of fixed contacts provided in the groove and the contacts of the switching member bridge over the desired contacts of the switch body, a number of desired circuits can be set using the switching members having contacts disposed in necessary positions and disposing them in any desired direction, that is, longitudinally or laterally.

(2) Since, in accordance with the invention, a miniature switch is construced so that a groove is provided in a switch body at substantially central portion thereof, a switching member engaged with contact(s) is disposed on a plurality of fixed contacts provided in the groove and the contacts of the switching member bridge over the desired contacts of the switch body, desired circuits can be set or circuits can be switched over by sliding the switching member(s) having contacts.

(3) Since, in accordance with the invention, a miniature switch is construced so that a groove is provided in a switch body at substantially central portion thereof, a switching member engaged with contact(s) is disposed on a plurality of fixed contacts provided in the groove and the contacts of the switching member bridge over the desired contacts of the switch body, the provision of only a single switching member causes the circuits to be set five to ten or more times in number, compared with the conventional switching member.

(4) Since the contacts are locked in the through-apertures provided on the sides of the switching member, the switching member can be easily assembled, and be carried in its blank condition. Therefore, the switching member can be easily stored.

(5) Since the projecting plates of the switch body are formed with recesses and the switching members of a projection-recess formed on the circumferential portion thereof, at the time of setting the circuit, even if some of the switching members have been already disposed on the end portions thereof, other switching member(s) can be mounted or removed from the central portion of the switch body from above without removing the already disposed switching members. Therefore, no additional work is required in a case where the switching members are set in or removed from the central portion of the switch body. Furthermore, since unnecessary switching members can be removed without removing other switching members, no error in orienting the switching members tends to take place during the setting thereof.

(6) When the switch body provided at the upper portion with recesses is used, and the switching members with or without the presence of projection-recess on the circumferential portion are selectively used, a wide range of applications can be attained due to their properties.

(7) When the switch body provided at the upper portion with recesses is used, and the switching members provided at the upper portion thereof with the raised portions and having no projection are used, a miniature switch can be obtained in which a good touch of switching action and the stopping positions of the switching members can be clearly seen.

(8) Since, in accordance with the invention, a miniature switch is construced so that a groove is provided in a switch body at substantially central portion thereof, a switching member engaged with contact(s) is disposed on a plurality of fixed contacts provided in the groove and the contacts of the switching member bridge over the desired contacts of the switch body, the switch can be used for a data module due to various changes of circuits.

(9) Furthermore, in accordance with the invention, by making the raised portions or recesses formed on the upper surface of the switching members to coincide with directions of arrangement of the contacts, construction of the circuit can be understood at a glance seen from the above.

Although the invention has been described in its preferred embodiments, it is to be understood that the invention is not limited to the specific embodiments, and for example one or more contacts may be disposed in the switching members and other changes can be easily made.

What is claimed is:

1. A miniature switch comprising:

a switch body having a longitudinal recess formed therein, said switch body including a plurality of pairs of fixed contacts positioned on an inner bottom surface of said longitudinal recess, and projecting plate members formed on opposing upper longitudinal sides of said switch body, said projecting plate members having a plurality of recesses formed therein at predetermined intervals; and a switching member operably connectable to said switch body including a pair of lateral apertures formed through opposing side edges of said switching member, at least one C-shaped contact member having distal ends thereof insertable into opposing ones of said pair of lateral apertures, and positioning projections formed in a surface of said switching member;

wherein said switching member is slidably inserted into the longitudinal recess of said switch body, said positioning projections snap-fitting within respective ones of the plurality of recesses formed in said projecting plate members, thereby aligning said at least one C-shaped contact member with at least one of said plurality of pairs of fixed contacts within said switch body to form an electrical connection between said switch body and said switching member.

2. The miniature switch according to claim 1, wherein said switch body further includes a plurality of pairs of terminal contacts corresponding to said plurality of pairs of fixed contacts for connecting said miniature switch to an external device.

3. The miniature switch according to claim 1, wherein said switching member further includes a spring member for biasing said C-shaped contact away from said switching means.

4. The miniature switch according to claim 1, wherein said switching member further includes indicator means, formed on an upper surface of said switching member, for indicating a directional orientation of said at least one C-shaped contact member.

5. The miniature switch according to claim 4, wherein said indicator means includes at least one elongated projection formed on the upper surface of said switching member.

6. The miniature switch according to claim 4, wherein said indicator means includes a pair of parallel elongated projections formed on an upper surface of said switching member.

7. The miniature switch according to claim 4, wherein said indicator means includes a pair of parallel elongated recesses formed within a surface of said switching member.

8. The miniature switch according to claim 1, wherein said plurality of pairs of fixed contacts are positioned orthogonally within the longitudinal recess of said switch body.

9. The miniature switch according to claim 1, wherein said plurality of pairs of fixed contacts are positioned in parallel with the longitudinal recess of said switch body.

10. The miniature switch according to claim 1, wherein said plurality of pairs of fixed contacts are positioned diagonally within the longitudinal recess of said switch body.

11. The miniature switch according to claim 1, wherein said at least one C-shaped contact member engages with any two of said plurality of pairs of fixed contacts.

* * * * *